United States Patent [19]

Slepian

[11] Patent Number: 4,468,035

[45] Date of Patent: Aug. 28, 1984

[54] WORD FORMING GAME APPARATUS

[76] Inventor: Joel M. Slepian, 306 Hunters La., Williamsville, N.Y. 14221

[21] Appl. No.: 524,112

[22] Filed: Aug. 18, 1983

Related U.S. Application Data

[63] Continuation of Ser. No. 308,430, Oct. 5, 1981, abandoned.

[51] Int. Cl.[3] ..... A63F 3/00

[52] U.S. Cl. ..... 273/243; 273/272

[58] Field of Search ..... 273/246, 243

[56] References Cited

U.S. PATENT DOCUMENTS

| | | | |
|---|---|---|---|
| 1,615,927 | 2/1927 | Atkinson | 273/248 |
| 3,414,264 | 12/1968 | Schriber | 273/249 |
| 3,642,285 | 2/1972 | Impastato | 273/243 |
| 4,055,347 | 10/1977 | Kreischer | 273/272 X |
| 4,060,246 | 11/1977 | Ward | 273/246 X |
| 4,123,062 | 10/1978 | Wexler et al. | 273/248 |
| 4,266,775 | 5/1981 | Chitnis et al. | 273/278 |
| 4,340,231 | 7/1982 | Cammarata | 273/243 |

FOREIGN PATENT DOCUMENTS

| | | | |
|---|---|---|---|
| 680380 | 8/1939 | Fed. Rep. of Germany | 273/243 |

*Primary Examiner*—Richard C. Pinkham
*Assistant Examiner*—Scott Brown

[57] ABSTRACT

A word forming game apparatus including a game board, game cards, game pieces and a plurality of dice. The game board contains a plurality of spaces defining columns or lanes, the extreme edges of which are bounded by a starting row and a finish row, respectively. The starting row has a plurality of adjacent spaces that are consecutively numbered, whereas the finish row has a plurality of adjacent spaces in alignment with the numbered spaces of the starting row; each space of which containing a letter of the alphabet that corresponds to the title word(s) of the game.

3 Claims, 4 Drawing Figures

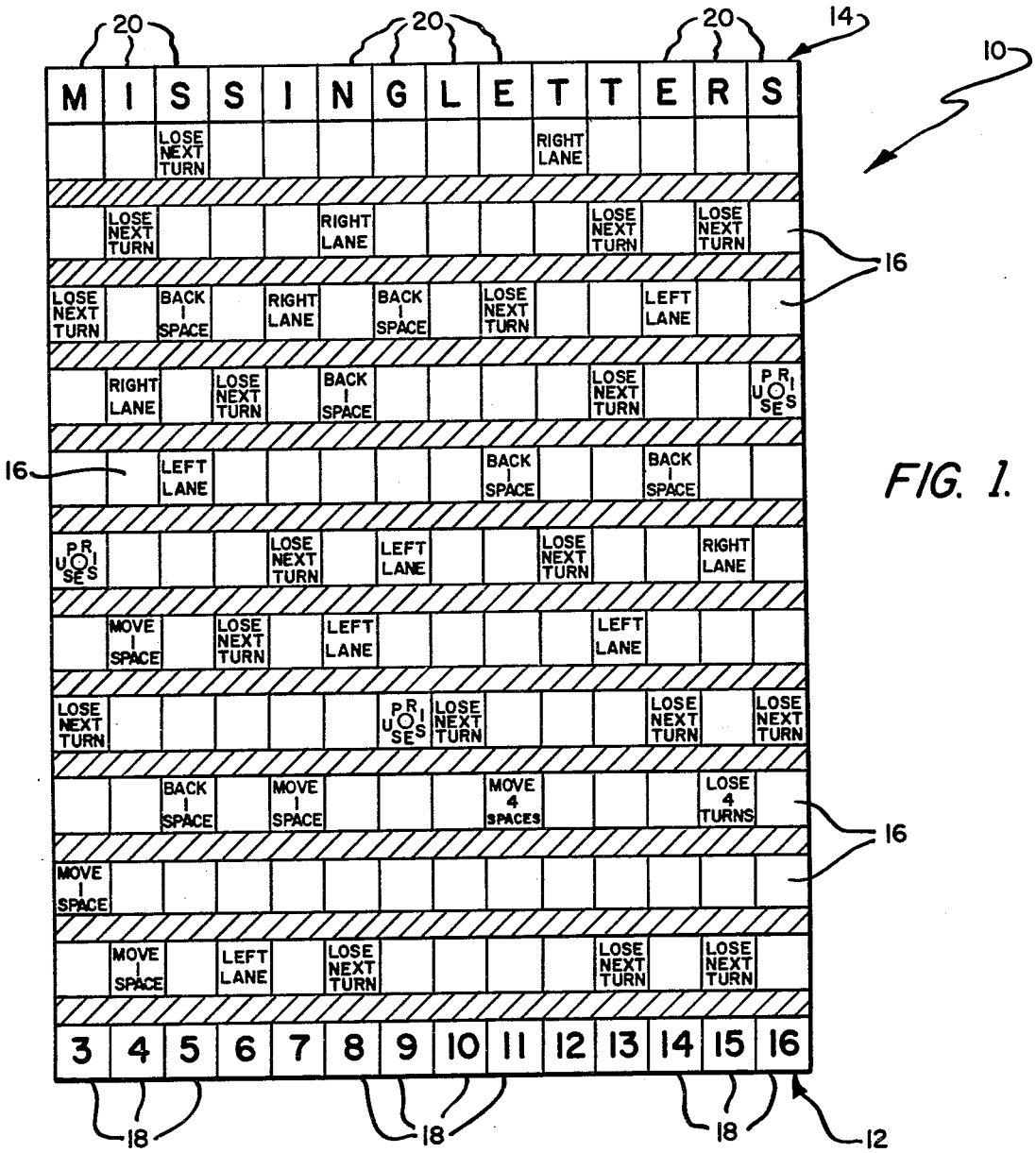
FIG. 1.
FIG. 2.
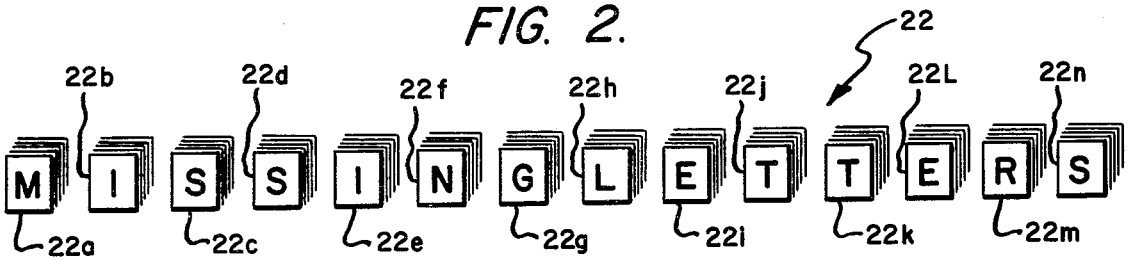
FIG. 3.
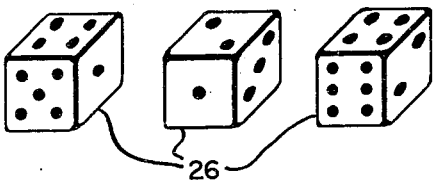
FIG. 4.
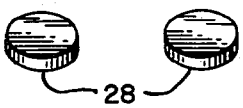

WORD FORMING GAME APPARATUS

This application is a continuation of application Ser. No. 308,430 now abandoned.

SUMMARY OF THE INVENTION

The present invention relates to games and, more particularly, to a word forming game that is easy to play by two or more players and to such a game that is extremely simple and educational for younger players.

The apparatus of the present invention includes a game board, a plurality of game pieces, a plurality of dice and a plurality of game cards. The game board is divided into a plurality of adjacent columns or lanes located intermediate a starting row and a finish row. The starting row contains a plurality of adjacent spaces which are consecutively numbered, whereas the finish row contains a corresponding plurality of spaces each of which contain a letter of the alphabet, which letters combine to spell the title of the game. Each column or lane contains a plurality of adjacent spaces that are in alignment with their respective starting row numbers and their finsih row letters. Dispersed at various predetermined ones of such adjacent spaces are commands or instructions which may have a strategic effect on the outcome of the game.

The game cards include a plurality of multi-card sets with the cards of each set thereof all containing one letter corresponding to the game-spelling letters of the finish row. The arrangement is such that the cards of the several sets contain duplicate letters which combine to spell the title of the game.

The object of the game is to use the cards to form any of the words that can be formed from the letters in the title of the game, including the title words as well. The first player to form any such word is the winner of the game. The game is, thus, extremely fast to play and will hold the attention and interest of any aged player. The manner of play and specific examples will follow hereinbelow.

Essentially, then, the present invention provides a word forming game apparatus which includes; a game board having a plurality of adjacent spaces arranged to form a plurality of columns or lanes; a starting row adjacent one edge of said lanes containing a plurality of consecutively numbered starting spaces with the number of which corresponding to the number of said lanes; and a finish row comprising a plurality of adjacent spaces along an opposite edge of said lanes, each individual space of which contains a letter of the alphabet that combines with the letters in the adjacent spaces to spell the title of the game.

BRIEF DESCRIPTION OF THE DRAWINGS

For a fuller understanding of the present invention and its characterizing features reference should now be had to the following detailed description thereof taken in conjunction with the accompanying drawings, wherein:

FIG. 1 is a top plan view of the game board of the apparatus of the present invention;

FIG. 2 is a top plan view of the game cards that are adapted to be used in playing the game of the present invention;

FIG. 3 is a pictorial view of the plurality of dice that are used in the game of the present invention; and FIG. 4 is a pictorial view of exemplary game pieces that may be used in playing the game of the present invention.

DETAILED DESCRIPTION OF THE PREFERRED EMBODIMENT

Referring in detail to the drawing FIGURES, the game board is generally depicted at 10 and is shown as comprising a starting row 12, a finish row 14 and a plurality of squrares or spaces 16 located therebetween. Starting row 12 includes a plurality of adjacent spaces 18 which may be consecutively numbered with the numerals 3 to 16, as viewed from left to right in FIG. 1. Other numerals may be employed, so long as they are consecutively numbered.

The finish row 14, similarly, includes a plurality of adjacent spaces 20; each of which being in alignment with their respective spaces 18 of the starting row. These spaces 20 each contain a letter of the alphabet and the adjacent letters are so arranged as to form the word or words of the title of the game. Thus, as depicted, if the game title is "MISSING LETTERS," then space 20 in alignment with the starting row number 3 contains the letter "M;" the space 20 in alignment with the starting row number 4 contains the letter "I;" the space 20 in alignment with the number 5 contains the letter "S;" the space 20 in alignment with the number 6 contains the letter "S;" the space 20 in alignment with the number 7 contains the letter "I;" the space 20 in alignment with the number 8 contains the letter "N;" the space 20 in alignment with number 9 contains the letter "G;" the space 20 in alignment with the number 10 contains the letter "L;" the space 20 in alignment with the number 11 contains the letter "E;" the space 20 in alignment with the number 12 contains the letter "T;" the space 20 in alignment with the number 13 contains the letter "T;" the space 20 in alignment with the number 14 contains the letter "E;" the space 20 in alignment with the number 15 contains the letter "R;" and the space 20 in alignment with the number 16 contains the letter "S;".

The spaces or squares 16 are arrayed into a plurality of columns or lanes (fourteen, as illustrated) located between the aligned starting row numerals and their respective finish row letters. Some of these spaces 16 are blank; however, others contain diverse commands or instructions that can either help or hinder each individual player, as will become apparent hereinbelow.

FIG. 2 depicts, generally at 22, the sets of cards that are used in playing the game of the present invention. As shown, each set **22*a*, 22*b*, 22*c* . . . 22*n* comprises a plurality of individual cards containing one of the game title letters. Thus, set 22*a* contains a plurality of cards each having the letter "M;" set 22*b* contains cards each having the letter "I;" set 22*c* contains cards each having the letter "S" and so on, with set 22*n* comprising a plurality of cards each containing the letter "S." It is to be understood that each set containing the same letter may be consolidated. Thus, sets 22*b* and 22*e* may be combined into one stack of "S"s; the sets 22*i* and 22L may be combined into one stack of "E"s; and the sets 22*i* and 22*k* may be combined into one stack of "T"s. However, it is also contemplated that the sets may remain separate as shown or, alternatively, they may be placed in their corresponding positions on the finish row 14**.

The object of the game is to be the first player to take sufficient cards from the diverse card sets **22*a* . . . 22*n*** to be able to form a single word from the many words that can be formed from the game letters. For example, with the letters of the words "MISSING LETTERS", the following words represent some of the winning possibilities:

| | |
|---|---|
| MISSING | SING |
| LETTER | IS |
| LETTERS | IN |
| MISS | MINE |
| LET | REST |
| LETS | IT |

The game may be played with three standard dice 26 as shown in FIG. 3 and playing pieces 28 (FIG. 4) of any suitable material, shape, size and colors. A single playing piece 28 is provided for each player. The board 10, similarly, may be fabricated of any suitable material and may be folding or nonfolding, as is well known in the art.

METHOD OF PLAYING

Each player tosses the dice 26, with the player having the highest dice total moving his playing disc 28 to the starting row lane and space 18 which corresponds to the dice total. As shown in FIG. 3, with a dice total of ten, the player would place his piece 28 in space 18 having the numeral ten. This procedure is followed by all the players. If the dice total happens to be more than 16, then the player tosses again until the total is 16 or less. If a player lands on a space occupied by a previous player in the starting row 12, he must toss the dice again until he lands on an unoccupied space in row 12. After one round is completed and all the players are on separate numbered spaces 16 in starting row 12, they can then toss the dice again in an attempt to move up the lane toward the finish row letter that is aligned with their starting row number. Thus, a player in starting row ten will be moving up the lane towards the letter "L".

If a player successfully moves up the lane to the finish row 14 he may then take a letter from one of the card sets 22 that corresponds to the letter on the space 20 in the finish row. Thus, the player in lane 10 should be able to take the letter "L" from the card set 22L. A player may decline to take the letter in the finish row if he feels it will not help him towards the formation of his word. Further, in order to land on the finish row letter, the player need not have the exact dice total. For example, if the player is three spaces away from the finish row 14 and he throws a five, he can land on the finish row and take a letter. After reaching the finish row and taking or declining his letter the player then starts over on his next throw of the dice in starting row 12 and either moves up the same lane or a new lane towards the same or a new letter in the finish row. The first player to form a word from the letters in the finish row 14 wins the game.

As previously indicated, some of the spaces 16 between the starting row and the finish row are provided with commands, directions or instuctions for the players if they land on any one of these spaces. These commands or directions can be summarized as follows:

| | |
|---|---|
| 1. SUPRISE | Player can choose any letter and will win the game if the letter completes his word. |
| 2. RIGHT LANE | Player must move one lane over to his immediate right, if unoccupied. If occupied, player must wait his next turn. |
| 3. LEFT LANE | Player must move one lane over to his immediate left, if unoccupied. If occupied, player must wait his next turn. |
| 4. LOSE NEXT TURN | Player must skip his next turn. |
| 5. MOVE 4 SPACES | Player must move 4 spaces towards the finish row letter. If fourth space is occupied, player must wait his next turn. |
| 6. MOVE 1 SPACE | Player must move one space forward if unoccupied. |
| 7. BACK 1 SPACE | Player must move backward one space, if unoccupied. |
| 8. LOSE 4 TURNS | Player must skip four consecutive turns. |

An example of one player's moves can be seen from the following simulation:

1. Dice total is 10—player moves to space number ten in starting row 12.
2. Dice total is 4—player moves four spaces up towards the letter "L", but he lands on "LOSE NEXT TURN." Player must then skip a turn.
3. Dice total is 9—player moves his piece 28 to finish row 14 and takes the letter "L" from card set 22L. Since player has not formed a word, he must start again in starting row 12.
4. Player's next dice total is 8—player moves to space number eight in starting row 12.
5. Player's dice total is 5—player lands on "LEFT LANE", he moves his piece into the space 16 immediately to the left in lane number seven in alignment with finish row letter "I".
6. Dice total is 7—player lands on finish row and takes the letter "I" from the card set 22e.
7. Next dice total is 18—player tosses the dice again.
8. Dice total is 16—player moves to space number sixteen in starting row 12 in alignment with finish row letter "S".
9. Dice total is 8—Player lands on "SURPRISE" where he has the option of choosing any letter he may want from the card sets 22. He would take the letter "L" to spell the word "ILL" and thereby win the game.

It can be thus seen that the present invention provides a very simple, quick and challenging game for two or more players. Variations in play are possible according to the age, skill and intelligence of the players. For example, one option would be to require a player to use all the letters he has to form a word before he can win the game. Another option would be to require a player to land on the finish row only with the exact dice total that will enable him to arrive there.

Although a preferred embodiment of the present invention has been disclosed and described, changes will obviously occur to those skilled in the art. It is, therefore, intended that the present invention is to be limited only by the scope of the appended claims.

What is claimed is:

1. A word forming game apparatus, comprising:

a game board having a plurality of adjacent spaces arranged to form a plurality of columns;

a starting row of spaces adjacent one edge of said columns, each space of which containing a plurality of consecutively numbered starting spaces adjacent one another and in alignment with respective ones of said columns;

a finish row comprising a plurality of adjacent spaces located adjacent an opposite edge of said columns, each space of which being in alignment with respective ones of said consecutively numbered starting spaces and containing a letter of the alphabet that combines with the letters in adjacent spaces to spell the title of the game;

said adjacent spaces between said starting row and said finish row comprising a predetermined number of blank spaces and a predetermined number of spaces containing instructional commands for the players of the game, whereby playing pieces can arrive at said finish row letters only after successfully moving from said starting row to said finish row along said blank spaces and along said instructional spaces;

a plurality of dice capable of generating numbers corresponding to said consecutively numbered starting row spaces; and a single game piece for each player.

2. The word forming apparatus according to claim 1, further comprising:

a plurality of sets of cards with the cards of each set containing letters of the alphabet that correspond to the title spelling letters contained within said finish row.

3. The word forming apparatus according to claim 1, wherein:

said columns are fourteen in number; and said starting row is consecutively numbered from three to sixteen; and said letters in said finish row are fourteen in number.

* * * * *